United States Patent [19]

Gane

[11] Patent Number: 4,728,539

[45] Date of Patent: Mar. 1, 1988

[54] PAPER COATING APPARATUS AND METHOD

[75] Inventor: Patrick A. C. Gane, Callington, United Kingdom

[73] Assignee: E.C.C. International Limited, United Kingdom

[21] Appl. No.: 843,985

[22] Filed: Mar. 25, 1986

[30] Foreign Application Priority Data

Apr. 1, 1985 [GB] United Kingdom ..... 8508431

[51] Int. Cl.[4] ..... B05C 3/18; B05D 1/26

[52] U.S. Cl. ..... 427/356; 118/103; 118/126; 118/413

[58] Field of Search ..... 118/356, 407, 413, 103, 118/126

[56] References Cited

U.S. PATENT DOCUMENTS 3,081,191 3/1963 Smith et al. ..... 118/126 X
3,179,536 4/1965 Martinek ..... 118/126 X
3,518,964 7/1970 Nagler ..... 118/126 X
4,369,731 1/1983 Damrau ..... 118/413 X

FOREIGN PATENT DOCUMENTS 1137232 12/1968 United Kingdom .

*Primary Examiner*—John P. McIntosh
*Attorney, Agent, or Firm*—Stefan J. Klauber

[57] ABSTRACT

A trailing blade paper coating apparatus is disclosed which comprises means providing a resilient curved surface for supporting a moving web of cellulosic material, an applicator for a paper coating composition and a trailing blade which in use is biased towards and in contact with the moving web of cellulosic material, and which further includes a flexible blade mounted so that, in operation of the trailing blade paper coating apparatus, the flexible blade is in contact with a web of cellulosic material to be coated at a location which is upstream relative to the trailing blade and downstream relative to the applicator for the coating composition. A method is also disclosed and claimed.

9 Claims, 3 Drawing Figures

PAPER COATING APPARATUS AND METHOD

This invention relates to an apparatus for, and to a method of, applying to the surface of a cellulosic sheet material, such as paper or board, a coating composition comprising a particulate inorganic pigment and an adhesive in an aqueous medium. More particularly, but not exclusively, the invention is concerned with the production of what is usually known as ultra-lightweight coated papers, i.e. papers coated with not more than 9 g. of dry coating composition per square metre of paper surface per side of paper.

BACKGROUND OF THE INVENTION

Inorganic pigments which have been found most suitable for incorporation in coating compositions for producing ultra-lightweight coated papers are minerals of the layer lattice silicate type of which kaolin clay is the most widely used, but coating compositions may also comprise other layer lattice silicate minerals such as talc. These layer lattice silicate minerals generally crystallise in the form of flat plates which may be relatively easily cleaved apart along a plane parallel to the face of the plates. If the coating applied to the surface of a sheet of cellulosic material is light in weight, it follows that the thickness of the dry coating will be small. It has been found that, if a coating is to possess good opacity, gloss and printing properties, the particles of the layer lattice silicate mineral in the coating composition should generally be of high aspect ratio, in other words the ratio of the longest dimension measured across the face of the particle to the thickness of the particle should be large, and the particles should be generally oriented with the plane of the plates parallel to the surface of the cellulosic material. Layer lattice silicate minerals generally exist in the form of particles consisting of stacks or clusters of plate-like crystals and the aspect ratio of the particles of such a mineral may be increased by cleaving apart the plates to provide a particulate material which consists predominantly of individual plates.

However, paper coating compositions containing a high proportion of particles of high aspect ratio suffer from the disadvantage that their rheological properties are generally poor, i.e. a paper coating composition containing a high percentage by weight of such particles tends to be highly viscous and to exhibit rheological dilatancy, i.e. the viscosity of the composition increases with the rate of shear applied to the composition. One way of overcoming this disadvantage would be to reduce the percentage by weight of particulate silicate mineral in the paper coating composition but such a measure would introduce other disadvantages, viz:

1. the cost of drying the coated material would be increased because the quantity of water to be evaporated per unit weight of pigment applied is increased;

2. the aqueous medium would tend to migrate rapidly into the cellulosic sheet material leaving the platelet particles immobilised in an orientation which may be far removed from the optimum orientation in which the plane of the plates are parallel to the surface of the cellulosic material; and 3. the particles would tend to collapse in random orientation into relatively large holes or fissures between fibres of the cellulosic sheet material with the result that the upper surface of the coating, when dried, would not be sufficiently smooth to receive a good print impression.

It is therefore desirable to use a coating composition containing the highest possible percentage by weight of particulate silicate mineral of high aspect ratio to produce an ultra-lightweight coated paper.

A widely used method of coating webs of cellulosic material utilises apparatus which includes a spring steel blade which in use extends across the web of cellulosic material to be coated and is biased into contact with the web, the web being generally supported on a slightly resilient curved surface, such as a roll faced with an elastomeric material. The blade generally makes an acute angle with the tangent to the curved supporting surface along the line of contact of the blade with the surface and is in a trailing attitude with respect to the direction of motion of the web. For obvious reasons such a blade is known as a "trailing blade" and an apparatus using such a blade is generally known as a "trailing blade paper coating apparatus". In one method of coating cellulosic material using a trailing blade paper coating apparatus an aqueous coating composition is introduced into a trough of which the floor and back are formed by the blade and its supporting structure, the sides are formed by suitable dams, and the front of the trough is closed by the web of cellulosic material on the curved support. In another method, an aqueous coating composition is applied to the web upstream of the trailing blade by a suitable applicator, such as a rotating roll or brush in contact with the moving web or by means of spray jets. In either method the trailing blade serves to remove surplus coating composition and to smooth and level the coating. If a coating composition, which is supported on a moving web of cellulosic material and contains a high percentage by weight of particles which are predominantly of high aspect ratio, is constrained to pass at high velocity beneath a trailing blade, the coating is suddenly exposed to conditions of very high shear and, as a result of the poor rheological properties of the coating composition (by virtue of the random orientation of particles of high aspect ratio), there tend to occur sudden changes in the velocity of flow of the composition beneath the blade and in the clearance between the blade and the web with the result that the coating is unevenly applied.

It is an object of the present invention to provide an apparatus for, and a method of, applying to a cellulosic sheet material a substantially smooth and level coating, even at a small thickness, of a composition which contains a relatively high percentage by weight of particles which are predominantly of high aspect ratio.

SUMMARY OF THE INVENTION

Accordingly, in one aspect, the present invention provides a trailing blade paper coating apparatus which comprises means providing a resilient curved surface for supporting a moving web of cellulosic material, an applicator for a paper coating composition and a trailing blade which in use is biased towards and in contact with the moving web of cellulosic material, and which further includes a flexible blade mounted so that, in operation of the trailing blade paper coating apparatus, the flexible blade is in contact with a web of cellulosic material to be coated at a location which is upstream relative to the trailing blade and downstream relative to the applicator for the coating composition.

In another aspect, the present invention provides a method of coating a web of cellulosic material with a coating composition comprising a particulate pigment material and an adhesive in an aqueous medium, which method comprises applying said coating composition to the surface of a moving web of a cellulosic material, passing the web and applied coating composition between a resilient supporting member and a trailing blade one edge of which is biased towards the supporting member, characterised in that the web and its applied coating are acted upon, at a position upstream relative to the trailing blade, by a flexible blade.

The flexible blade employed in the apparatus and method of the present invention should be constructed and mounted so that when it is in contact with a web of cellulosic material its free edge flexes sufficiently to be substantially tangential to the web at the point of contact. The flexible blade is advantageously made of a plastics materials, such as polytetrafluoroethylene or poly(vinyl chloride), although an elastomeric material, such as a natural or synthetic rubber, can be used. It may also be possible to employ a thin, flexible metallic material. In one embodiment the flexible blade is retained, for example clamped, along one edge in suitable retaining means and its free edge is arranged to contact the web supported on a curved surface substantially tangentially. More generally, the flexible blade should be mounted in a manner such that it applies enough pressure to limit the weight of wet paper coating composition which is allowed to pass beneath the flexible blade to not more than 10% by weight in excess of the amount which is required to give the final desired dry coating weight. Preferably, the flexible blade is itself supported near to the retaining means by a curved former, for example a resilient bar, which may advantageous be a length of flexible, plastomeric or elastomeric tubing.

The flexible blade is preferably mounted so that, in operation, the distance between the lines of contact of the flexible blade and the trailing blade with the web of cellulosic material is such that the time taken for a fixed point on the web to travel between the two lines of contact at the normal operating speed of travel of the web is not larger than 15 milliseconds. For example, on an industrial paper coating machine which normally runs at a speed of 1500 $m.min^{-1}$ (meters per minute) the time taken to travel between the two blades is 10 ms (milliseconds) if the blades are 25 cm apart. In one embodiment of the invention the trailing blade and/or the flexible blade are movable relative to each other to enable the time taken for a fixed point on the web to travel between the two lines of contact of the flexible blade and the trailing blade to be adjusted.

It is believed that the flexible blade of a trailing blade paper coating apparatus in accordance with the invention functions by applying to the coating composition on the surface of the web a gradually increasing shear which causes particles, especially those in the form of platelets having a high aspect ratio, in the coating composition to orient themselves with the plane of the platelet parallel to the surface of the web. As a result, the coating composition passing under the trailing blade has its particles preoriented and a much smoother flow of coating composition under the trailing blade is possible. It is therefore possible to use coating compositions containing pigment particles of high aspect ratio at a higher percentage by weight of pigment in the composition than is possible with conventional trailing blade coating apparatus. It is also possible to increase the pressure under which the trailing blade is biased against the resilient supporting member, and trailing blade pressures up to about twice those used in conventional trailing blade paper coating apparatus are practicable. As a result, very thin coatings having a coat weight in the range of from 2 to 3 $g.m^{-2}$ per side are obtainable. A further consequence of the preorientation of the particles is that the particles, substantially all of which are oriented with the platelets parallel to the surface of the paper, pack closely together in, or bridge across, any relatively large holes or fissures between the fibres of the cellulosic material, and remain oriented by virtue of the high viscosity of the composition, with the result that a smooth, level coating having good opacity, gloss and printing properties is obtainable.

DESCRIPTION OF EMBODIMENTS

Figure 1:
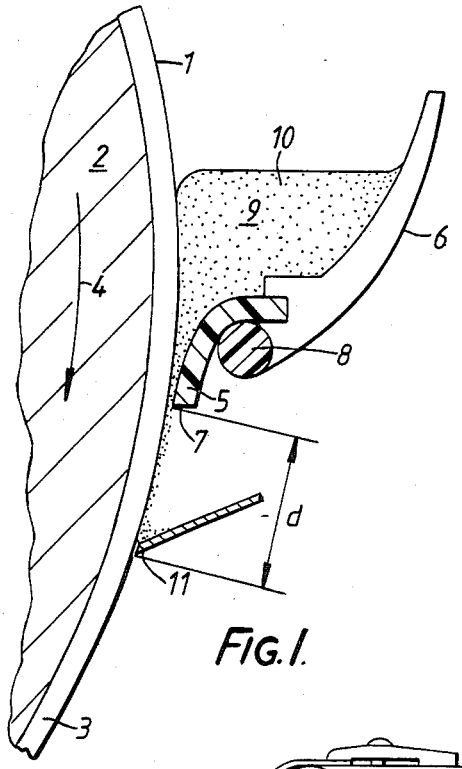
Figure 2:
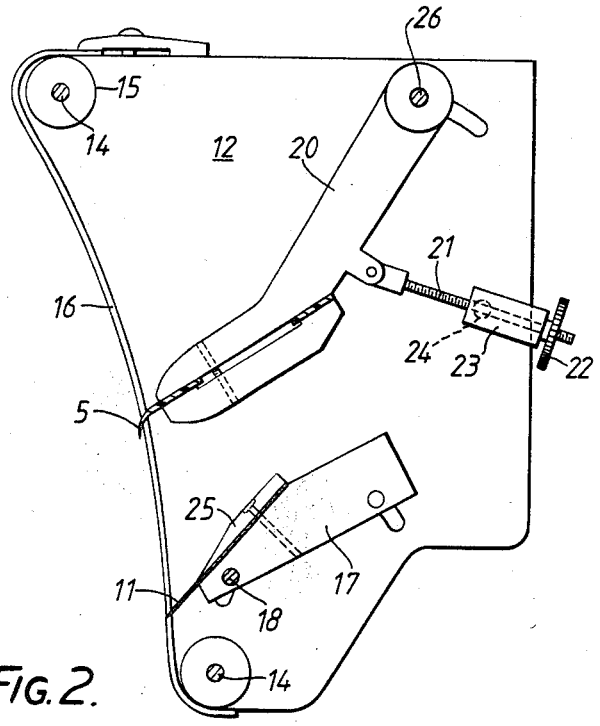
Figure 3:
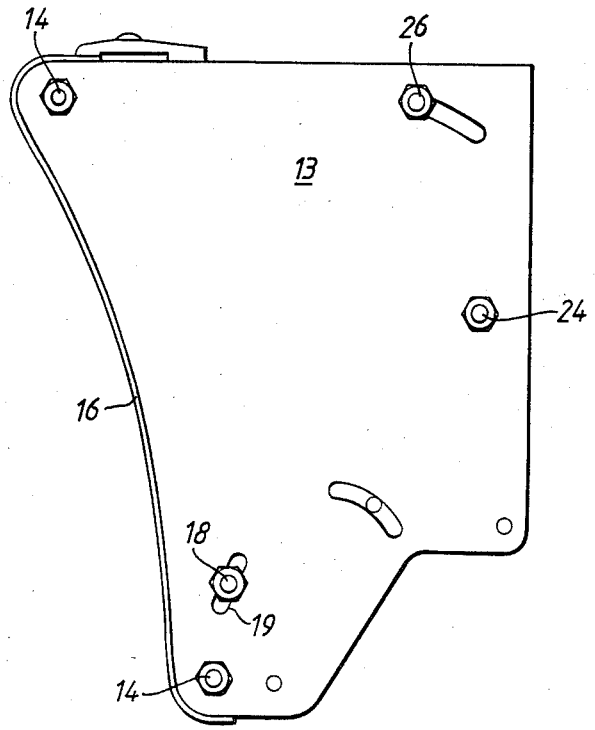

For a better understanding of the invention, and to show more clearly how the same may be carried into effect, reference will now be made, by way of example, to the accompanying drawings in which:

FIG. 1 shows diagrammatically part of one embodiment of a trailing blade paper coating apparatus in accordance with the invention; and FIGS. 2 and 3 show diagrammatically part of another embodiment of a trailing blade paper coating apparatus in accordance with the invention.

Referring first to FIG. 1, there is shown a web of paper 1 supported on a steel roll 2 which is provided with a facing 3 of an elastomeric material. The roll 2 is rotated so as to advance the web in the direction shown by the arrow 4. A flexible blade 5, made of polytetrafluoroethylene, is clamped along one edge to a supporting member 6 and the free edge 7 of the blade contacts the moving web substantially tangentially to the roll 2. Along that edge of the supporting member 6 facing the roll there is secured a length of polyethylene tubing 8, part of the curved outer surface of which supports and defines the curvature of the flexible blade 5. A trailing blade 11 made of thin spring steel is biased against the web by means not shown.

In operation, a coating composition 9, which comprises a layer lattice silicate mineral having particles of high aspect ratio and an adhesive in suspension in water, is introduced into a trough 10 which is defined by the web 1, the flexible blade 5, the supporting member 6 and two dams (not shown). The trailing blade 11 serves to remove excess coating composition and to smooth and level the coating. The distance "d" between the lines of contact of the flexible blade 5 and trailing blade 11 is 6 cm which, for a speed of travel of the web of 400 $m.min^{-1}$, gives a time of travel between the two blades of 9 ms. This is a typical spacing between the blades but many other configurations are possible although it is preferred that the time of travel of the coated web between the flexible blade and trailing blade does not exceed 15 ms.

Turning now to FIGS. 2 and 3, there is shown a coating head which has been designed for use in conjunction with a laboratory scale, trailing blade paper coating apparatus of the type described in British patent specification No. 1,032,536. The coating head comprises two side walls 12 and 13 which are held in the desired parallel relationship with one another by nut and bolt assemblies 14 in rigid tubular sleeves 15. The forward facing edges 16 of the side walls are curved to confirm to the periphery of the roll 2 (corresponding to the backing roll 4 shown in FIG. 1 of British patent specification No. 1,032,536) of the laboratory scale trailing blade paper coating apparatus and are faced with strips of poly(tetrafluoroethylene) of thickness 1.6 mm. A trailing blade 11 of thin, spring steel is clamped between steels jaws 25 attached to a substantially rectangular holder 17 which is fixed in place by means of screws 18 passing through holes 19 in the side walls. A flexible blade 5 made of polytetrafluoroethylene and having a thickness of 0.16 mm is clamped with a length of 16 mm of the blade protruding in a holder 20 of dog leg shape which is pivotally connected to the side walls by a nut and bolt assembly 26. The angle of the holder 20 is adjustable by means of a screw 21 provided with a knurled knob 22, the screw co-operating with a threaded block 23 which is fixed in place by means of a nut and bolt assembly 24. The side walls, blade holders and sleeves 15 are made from the material known as "TUFNOL" (Registered Trade Mark) which is formed by impregnating a textile material with a phenolformaldehyde resin. The sleeves 15 are made of nylon.

The invention is further illustrated by the following Examples.

EXAMPLE 1

Examples of a gravure printing base paper were coated with a rotogravure paper coating composition prepared according to the following formulation:

| Ingredient | Parts by Weight |
|---|---|
| Pigment | 100 |
| Sodium polyacrylate dispersing agent | 0.3 |
| Self-thickening acrylic copolymer latex adhesive | 4.8 |
| Sodium hydroxide to pH 9 | |
| Water to appropriate fluidity | |

The following four pigments were used:

A. A kaolin clay having a particle size distribution such that 6% by weight of particles had an equivalent spherical diameter larger than 10 μm, 40% of weight of particles had an equivalent spherical diameter smaller than 2 μm and 25% of weight of particles had an equivalent spherical diameter smaller than 1 μm;

B. A kaolin clay having a particle size distribution such that 4% by weight of particles had an equivalent spherical diameter larger than 10 μm, 82% by weight of particles had an equivalent spherical diameter smaller than 2 μm and 60% by weight of particles had an equivalent spherical diameter smaller than 1 μm;

C. 90% by weight of Pigment B+10% by weight of muscovite mica consisting predominantly of particles having diameters in the range from 5 μm to 50 μm; and D. 70% by weight of Pigment B+30% by weight of the same mica as was used in Pigment C.

Samples of the base paper were coated with compositions containing each of the four pigments by means of:

Type 1. A conventional trailing blade coating head comprising a single spring steel blade; and Type 2. A coating head according to the invention and as shown in FIGS. 2 and 3 comprising a trailing blade of thin spring steel and a flexible, preorientating blade of polytetrafluoroethylene of thickness 1.6 mm.

The coating heads were mounted on a "HELICOATER" (Registered Trade Mark) laboratory scale paper coating apparatus of the type described in British Patent Specification No. 1,032,536 and the drum was rotated at a speed such that the paper attached to the drum passed beneath the blades at a speed of 400 meters per minute. Before coating, the percentage by weight of total dry solids in each paper coating composition was determined and the viscosity was measured by means of a Brookfield Viscometer with a spindle speed of 100 rpm. Coatings were applied to the base paper to give weights of dry coating varying in the range from about 4 to about 11 $gm^{-2}$ by varying the pressure applied to bias the coating head against the drum. Each coating was thermally dried and the gloss of the dry coating was measured according to TAPPI Standard No. T480 ts-65 and the gravure printing quality was tested by the method described in the article "Realistic paper tests for various printing processes" by A Swan published in "Printing Technology" vol 13, No. 1, April 1969, pages 9–12 and in British patent specification No. 2,058,734.

Before testing, the samples of coated paper were calendered at a line pressure of 500 lb per linear inch (89 kg per cm) for 10 passes at 65° C. For each combination of coating composition and coating head there were estimated, by interpolation, the gloss and gravure printing quality results which corresponded to a dry coating weight of 7 $gm^{-2}$. In the case of gravure printing quality the lowest figure represents the best result. The results obtained are set forth in Table I below:

TABLE I

| Pigment/coating head combination | % by wt of solids | Viscosity (mPa.s) | TAPPI gloss units | Gravure printing quality |
|---|---|---|---|---|
| A1 (comparative) | 60.1 | 1580 | 43 | 4 |
| A2 (invention) | 61.9 | 2480 | 46 | 2.5 |
| B1 (comparative) | 56.9 | 1640 | 61 | 7.5 |
| B2 (invention) | 58.1 | 2280 | 59 | 5.5 |
| C1 (comparative) | 58.2 | 1660 | 54 | 7.5 |
| C2 (invention) | 60.1 | 2450 | 57 | 4.5 |
| D1 (comparative) | 59.1 | 1680 | 49 | 7.5 |
| D2 (invention) | 61.2 | 2500 | 53 | 3 |

These results show that use of the coating head in accordance with the invention makes it possible to use compositions of greater solids concentration and thus reduce the amount of water which must be thermally evaporated during drying of the coated paper. A further advantage of the higher solids concentration and thus higher viscosity is that the time during which water from the composition drains into the base paper is reduced and therefore the particles in the composition are more likely to retain the orientation given to them as they pass beneath the pre-orientating flexible blade. It can also be seen from these results that the use of the coating head of the invention gives improved gravure printing quality and, in most cases, improved gloss. These improvements become more pronounced as the proportion of high aspect ratio particles, i.e. the proportion of mica particles between about 5 μm and about 50 μm in size is increased.

Example 2

Samples of a web offset printing base paper were coated on the laboratory scale trailing blade paper coating apparatus at a paper speed of 400 meters per minute with a composition prepared according to the following formulation:

| Ingredient | Parts by weight |
|---|---|
| Pigment | 100 |
| Sodium polyacrylate dispersing agent | 0.3 |
| Styrene butadiene latex adhesive | 12 |

-continued

| Ingredient | Parts by weight |
|---|---|
| Sodium carboxymethylcellulose | 1 |
| Sodium hydroxide to pH 9 | |
| Water to appropriate fluidity | |

The pigment comprised 90% by weight of a kaolin clay, having a particle size distribution such that 1% by weight of particles had an equivalent spherical diameter larger than 10 μm and 80% by weight of particles had an equivalent spherical diameter smaller than 2 μm, and 10% by weight of the same mica as was used in Example 1.

The pigment was coated on to samples of paper using coating heads of both Type 1 and Type 2 as described in Example 1 above. In the case of the Type 1 coating head water was added to the composition to give a viscosity of 1500 mPas as measured by means of the Brookfield Viscometer at a spindle speed of 100 rpm and the percentage by weight of total dry solids in the composition was found to be 60%. In the case of the Type 2 coating head, water was added to give a viscosity of 2000 mPas or a solids concentration of 63% by weight.

Coatings were applied at varying blade pressures to give dry coating weights in the range from about 3 to about 9 $gm^{-2}$. Each sample of coated paper was thermally dried and calendered at a line pressure of 89 kg per cm for 10 passes at 65° C. and the gloss was measured according to TAPPI Standard No. T 480 ts-65. The gloss corresponding to a dry coating weight of 5 $gm^{-2}$ was found in each case by interpolation. The results obtained are set forth in Table II below:

TABLE II

| Coating head | TAPPI gloss units |
|---|---|
| Type 1 (comparative) | 39 |
| Type 2 (invention) | 47 |

I claim:

1. A trailing blade paper-coating apparatus which comprises, means providing a resilient curved surface for supporting a moving web of cellulosic material, an applicator for a paper-coating composition, and a trailing blade which is biased for contact with the moving web of cellulosic material, and which further includes a flexible blade mounted so that, in operation of the trailing blade paper-coating apparatus, the flexible blade will be in tangential contact with the moving web of cellulosic material to be coated at a location which is upstream relative to the trailing blade and downstream relative to the applicator for the coating composition, and the distance between said blades is such that the time which will be required for a fixed point on the web of cellulosic material moving at a predetermined rate to travel between the line of contact of the flexible blade and the line of contact of the trailing blade will be at most 15 milliseconds.

2. A trailing blade paper coating apparatus as claimed in claim 1, wherein the flexible blade is made of a plastics material, an elastomeric material, or a thin, flexible metallic material.

3. A trailing blade paper coating apparatus as claimed in claim 1, wherein the apparatus further comprises means for moving the trailing blade and the flexible blade relative to one another.

4. A trailing blade paper coating apparatus as claimed in claim 2, wherein the apparatus further comprises means for moving the trailing blade and the flexible blade relative to one another.

5. A trailing blade paper coating apparatus as claimed in claim 1, wherein the flexible blade is retained along one edge by retaining means and wherein the apparatus further comprises a curved former for supporting the flexible blade near to said retaining means.

6. A trailing blade paper coating apparatus as claimed in claim 2, wherein the flexible blade is retained along one edge by retaining means and wherein the apparatus further comprises a curved former for supporting the flexible blade near to said retaining means.

7. A trailing blade paper coating apparatus as claimed in claim 3, wherein the flexible blade is retained along one edge by retaining means and wherein the apparatus further comprises a curved former for supporting the flexible blade near to said retaining means.

8. A trailing blade paper coating apparatus as claimed in claim 4, wherein the flexible blade is retained along one edge by retaining means and wherein the apparatus further comprises a curved former for supporting the flexible blade near to said retaining means.

9. A method of coating a web of cellulosic material with a coating composition comprising a particulate pigment material and an adhesive in an aqueous medium, which method comprises applying said coating composition to the surface of a moving web of cellulosic material, passing the web and applied coating composition between a resilient supporting member and a trailing blade having one edge which is biased towards the supporting member, and acting upon the web applied coating at a position upstream relative to the trailing blade with a flexible blade lying tangentially and thereby acting parallel to the web at the point of contact with the web so as to reduce the thickness of the applied coating composition before it passes beneath the trailing blade, and wherein the time taken for a fixed point on the web of cellulosic material to travel between the line of contact with the flexible blade and the line of contact with the trailing blade is at most 15 milliseconds.

* * * * *